US011609538B2

(12) United States Patent
Di Piazza et al.

(10) Patent No.: US 11,609,538 B2
(45) Date of Patent: Mar. 21, 2023

(54) WATCH NOTCHING DEVICE

(71) Applicant: ROLEX SA, Geneva (CH)

(72) Inventors: Philippe Di Piazza, Ville-la-Grand (FR); Jean-Baptiste Robin, Annemasse (FR); Alain Ruck, Soral (CH)

(73) Assignee: ROLEX SA, Geneva (CH)

( * ) Notice: Subject to any disclaimer, the term of this patent is extended or adjusted under 35 U.S.C. 154(b) by 693 days.

(21) Appl. No.: 16/424,858

(22) Filed: May 29, 2019

(65) Prior Publication Data

US 2019/0384224 A1 Dec. 19, 2019

(30) Foreign Application Priority Data

Jun. 13, 2018 (EP) ..... 18177590

(51) Int. Cl.
*G04B 19/28* (2006.01)

(52) U.S. Cl.
CPC ..... *G04B 19/286* (2013.01)

(58) Field of Classification Search
CPC ..... G04B 19/18; G04B 19/223–225; G04B 19/28–286
See application file for complete search history.

(56) References Cited

U.S. PATENT DOCUMENTS 5,122,997 A 6/1992 Schneider et al.
5,319,617 A 6/1994 Sonoda
5,631,880 A * 5/1997 Houlihan ..... G04B 19/283 368/286
5,654,941 A * 8/1997 Joss ..... G04B 19/283 368/295
6,599,009 B2 * 7/2003 Terasawa ..... G04B 19/283 368/294
6,871,997 B2 3/2005 Hartmann et al.
9,348,315 B2 * 5/2016 Cattaneo ..... G04B 19/223
2001/0040840 A1 * 11/2001 Terasawa ..... G04B 19/283 368/295

(Continued)

FOREIGN PATENT DOCUMENTS

EP 0 403 717 A1 12/1990
EP 1 431 845 A1 6/2004

(Continued)

OTHER PUBLICATIONS

European Search Report and Written Opinion dated Dec. 4, 2018 issued in counterpart application No. EP18177590; w/ English machine translation (12 pages).

*Primary Examiner* — Daniel P Wicklund
(74) *Attorney, Agent, or Firm* — WHDA, LLP

(57) ABSTRACT

A watch spring (1) for a first component (2), more particularly for a bezel or for a case middle or for a case back, intended for the detent of the first component (2) relative to a second component (3), the spring (1) comprising at least one first connecting element (10*a*) intended to interact with at least one second connecting element (20*b*) provided on a component (2*b*) of the first component so as to connect the spring and the component, the at least one first connecting element comprising at least one elastic connecting arm (10*a*) extending in a first direction (D1), the at least one first connecting element being intended to receive a force (F) for driving the first component relative to the second component in the first direction or substantially in the first direction.

19 Claims, 5 Drawing Sheets

(56) References Cited

U.S. PATENT DOCUMENTS

| | | | | |
|---|---|---|---|---|
| 2003/0169645 | A1* | 9/2003 | Eleuterio | G04B 19/283 368/295 |
| 2004/0141424 | A1 | 7/2004 | Hartmann et al. | |
| 2013/0201804 | A1* | 8/2013 | Bertrand | G04B 19/22 368/281 |
| 2013/0315043 | A1* | 11/2013 | Jacobi, Jr. | G04B 45/0092 368/228 |
| 2013/0329536 | A1* | 12/2013 | Silvant | G04B 19/283 368/295 |
| 2015/0185702 | A1 | 7/2015 | Silvant | |
| 2015/0227113 | A1* | 8/2015 | Cattaneo | G04B 19/223 368/295 |
| 2016/0109853 | A1* | 4/2016 | Kobayashi | G04B 19/22 368/295 |
| 2017/0364032 | A1* | 12/2017 | Brunet | G04B 19/286 |
| 2018/0032033 | A1 | 2/2018 | Mollier et al. | |
| 2019/0265655 | A1* | 8/2019 | Naka | G04R 60/10 |

FOREIGN PATENT DOCUMENTS

| | | | |
|---|---|---|---|
| EP | 2 672 333 | A1 | 12/2013 |
| EP | 3 276 187 | A1 | 1/2018 |

* cited by examiner

WATCH NOTCHING DEVICE

This application claims priority of European patent application No. EP18177590.9 filed Jun. 13, 2018, the content of which is hereby incorporated by reference herein in its entirety.

The invention relates to a watch spring, more particularly a notching spring. It also relates to a watch component comprising a suchlike spring. It further relates to a watch assembly comprising a suchlike spring or a suchlike component. It further relates to a timepiece, more particularly a wristwatch, comprising a suchlike spring or a suchlike component or a suchlike assembly. It relates, finally, to a method of assembly of a suchlike assembly or a suchlike timepiece.

Timepieces are provided with notching springs, for example, for the implementation of a notched rotating bezel.

Application EP1431845 discloses a suchlike construction, for example, in which a spring in a closed loop is configured to exert radial forces with respect to an annular cam, so as to generate the notching of a rotating bezel. In a given embodiment, this spring is equipped with cylindrical guides intended to be engaged in grooves formed on the bezel, in order, more particularly, to constrain said bezel and said spring in rotation in the course of assembly of the bezel on the case middle of the watch case.

A suchlike assembly operation may prove difficult to the extent that it is necessary to position the grooves of the bezel with respect to the cylindrical guides of the spring, whereas the grooves formed on the bezel are concealed by a bezel disc or a setting of precious stones. Furthermore, a suchlike spring equipped with cylindrical guides may be particularly cumbersome, more particularly for the implementation of a stone-set bezel.

Irrespective of the embodiment of the spring disclosed by application EP1431845, three bulges separated by elastic notching arms are provided in order to interact with an annular cam. In an embodiment in which the spring is disposed on the bezel, said spring and said bezel are constrained to rotate in both directions, by means of rigid means which take the form of cylindrical guides or pins pressed in at the level of each of the bulges of the spring. In an embodiment in which the spring is disposed on the case middle, the spring is secured against rotation with respect to the case middle by means of inward projections formed at the level of each of the bulges of the spring.

Application EP2672333 discloses a notched bezel device. In a first embodiment, the notching spring is in the form of a ring equipped with notching tabs intended to interact with a toothing. The notching spring in this case is attached to the bezel by means of securing elements such as pins. For this purpose, cut-outs are formed in the ring so as to receive the securing elements. A suchlike notching device or a suchlike spring is devoid of a connecting device equipped with elastic means, configured for the connection of said spring to the bezel or the case middle at least in two directions.

Application EP3276187 discloses a notching device between a first finishing component and a second finishing component, between which a notching spring is interposed. This spring takes the form of a snap-ring equipped with a bulge formed between two elastic notching tabs. Each of the elastic notching arms is equipped with a foot so as to connect the snap-ring to one or other of the finishing components in at least two directions.

The aim of the invention is to make available a notching device to address the aforementioned disadvantages and to improve the notching devices that are known from the prior art. In particular, the invention proposes a compact, reliable and simple watch spring to simplify the assembly of a notching device.

A spring according to the invention is defined by the following point 1.

1. A watch spring for a first component, more particularly for a bezel or for a case middle or for a case back, intended for the notching of the first component relative to a second component, the spring comprising at least one first connecting element intended to interact with at least one second connecting element provided on a component of the first component so as to connect the spring and the component, the at least one first connecting element comprising at least one elastic connecting arm extending in a first direction, the at least one first connecting element being intended to receive a force for driving the first component relative to the second component in the first direction or substantially in the first direction.

Different embodiments of the spring are defined by the following points 2 to 9.

2. The spring as defined in the preceding point, wherein the first direction is orthoradial relative to an axis of rotation of the spring or to an axis passing through the center of gravity of the spring and perpendicular or substantially perpendicular to the spring or to a plane in which the spring extends.
3. The spring as defined in one of the preceding points, wherein the elastic connecting arm has a free extremity forming a face perpendicular or substantially perpendicular to the first direction, and/or wherein the elastic connecting arm has a longitudinal dimension greater than or equal to 15 times, or greater than or equal to 20 times, or greater than or equal to 25 times the transverse dimension of the arm, and/or in that the arm has a retraction ramp.
4. The spring as defined in one of the preceding points, wherein the spring has an overall annular form, more particularly a form that is overall annular and is tangent or substantially tangent to the first direction.
5. The spring as defined in one of the preceding points, wherein the first connecting element comprises two elastic connecting arms, more particularly two arms of which the free extremities face towards one another or two arms that are symmetrical relative to a plane comprising an axis passing through the center of gravity of the spring and orthogonal or substantially orthogonal to the spring or to the plane in which the spring extends.
6. The spring as defined in one of the preceding points, wherein it comprises several, more particularly two or three or four or five, first connecting elements.
7. The spring as defined in the preceding point, wherein the several first connecting elements are distributed at regular intervals along the circumference of the spring.
8. The spring as defined in one of the preceding points, wherein it comprises at least one first indexation or notching structure intended to interact with at least one second indexation or notching structure provided on a second component.
9. The spring as defined in the preceding point, wherein the first connecting element is disposed at the level of one of the at least one first structure.

A watch component according to the invention is defined by the following point 10.

10. A component, more particularly a bezel or a case middle or a case back, comprising a spring as defined in one of the preceding points.

A watch assembly according to the invention is defined by the following point 11.

11. A watch assembly, more particularly a watch case, comprising a first watch component as defined in the preceding point and a second watch component, the second watch component comprising a second indexation or notching structure adapted to interact with at least one first indexation or notching structure provided on the first component.

An embodiment of the watch assembly is defined by dependent the following point 12.

12. A watch assembly as defined in the preceding point, wherein the at least one first connecting element is arranged so as to transmit a force for driving the first component relative to the second component of which the intensity is greater than or equal to 1.5 times, or greater than or equal to 2 times, or greater than or equal to 2.5 times, or greater than or equal to 3 times the intensity of the notching force.

A timepiece according to the invention is defined by the following point 13.

13. A timepiece, more particularly a wristwatch, comprising an assembly as defined in point 11 or 12 and/or a component as defined in point 10 and/or a spring as defined in one of points 1 to 9.

A method of assembly according to the invention is defined by the following point 14.

14. A method for the mounting or assembling of an assembly as defined in point 11 or 12 or of a timepiece as defined in the preceding point, the method comprising the following stages:

Installation of the first component on the second component,

Displacement, more particularly rotation, of the first component relative to the second component and deformation, more particularly bending deformation, of the elastic connecting arm of the spring by the action of the second connecting element on the elastic connecting arm, Return of the elastic connecting arm of the spring so as to position the extremity of the elastic connecting arm at the level of the second connecting element.

An embodiment of the method of assembly is defined by the following point 15.

15. The method of mounting or assembling as defined in the preceding point, wherein the elastic connecting arm is deformed in bending in the plane of the spring and/or perpendicularly to the plane of the spring.

The figures annexed hereto represent by way of example an embodiment of a timepiece.

Figure 1:
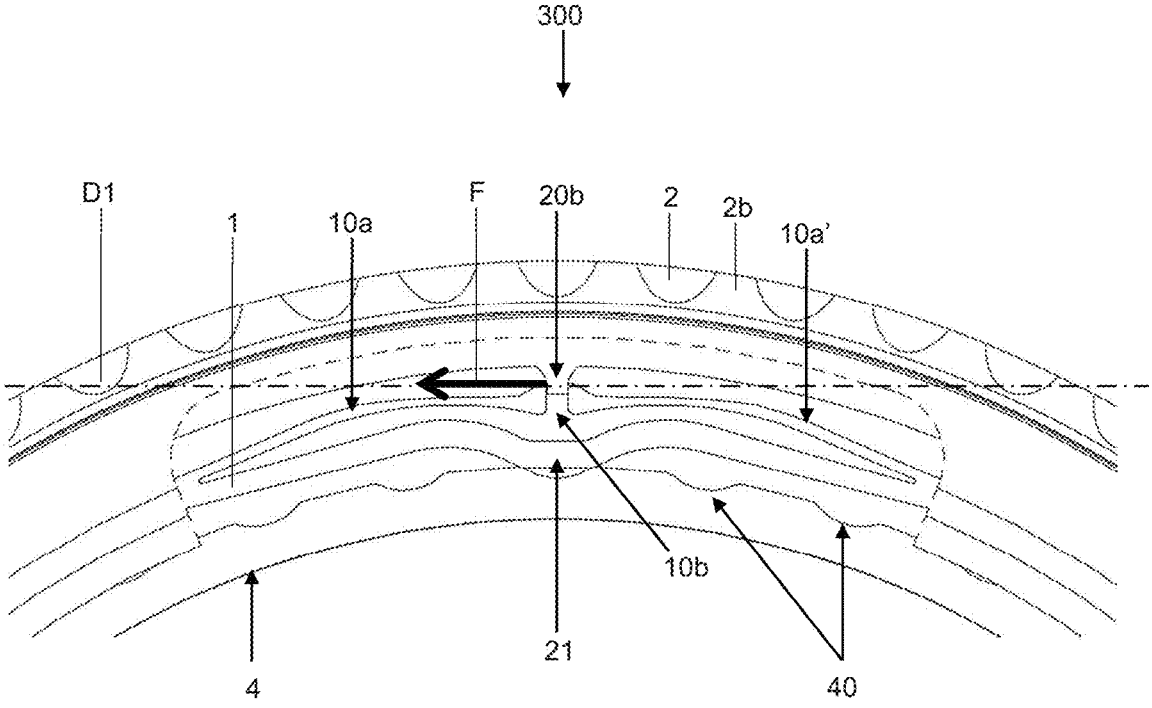
FIG. 1 is a partial view of a first embodiment of a timepiece at the level of the notching of a bezel.
Figure 2:
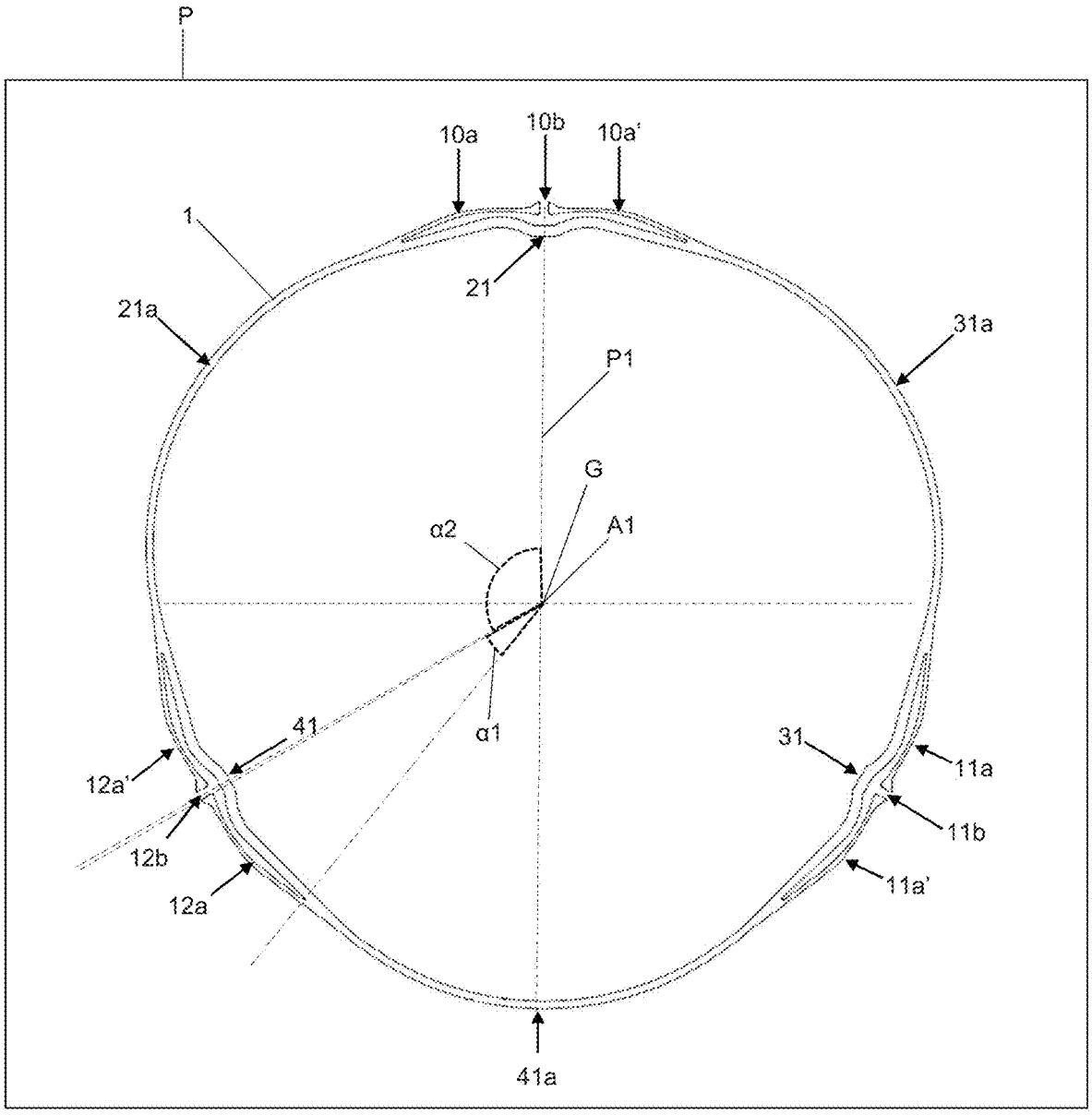
FIG. 2 is a view from above of a notching spring.

An embodiment of a timepiece 300 is described below with reference to FIGS. 1 to 8. The timepiece is a watch or a wristwatch, for example. The timepiece may comprise a mechanical movement, in particular an automatic movement, or an electronic movement. The timepiece may further comprise a watch assembly, more particularly a watch case 7 intended to contain the movement.

The watch assembly advantageously comprises a first watch component 2 and a second watch component 3. The first component is for example a mobile or rotating bezel. The second component is a case middle, for example. The first component is thus advantageously mobile relative to the second component. A notching is advantageously realized between the first and second components. For this purpose, the second component comprises a second indexation or notching structure 40, for example. This second indexation or notching structure 40 is intended to interact with at least one first indexation or notching structure 21 provided on the first component 2.

The first component 2, more particularly the bezel, comprises a spring 1. The first component may also comprise a component 2*b*, more particularly a ring 2*b*. Thus, the first component comprises the spring 1 and one or more other elements or components. These one or more other elements or components are referred to below as "rest of the first component".

The spring is advantageously intended for the realization of the indexation or of the notching between the first component and the second component. More particularly, the at least one first indexation or notching structure 21 may be realized by the spring, that is to say by structures on the spring. For example, the at least one first structure comprises three bulges 21, 31, 41 separated by elastic notching arms 21*a*, 31*a*, 41*a*. These bulges are intended to interact and to exert radial forces against an element of the case middle 4 containing hollows 40 intended to interact with the bulges. This element of the case middle 4 may thus be viewed or considered as a cam, more particularly an annular cam.

The watch spring 1 comprises at least one first connecting element 10*a* intended to interact with at least one second connecting element 20*b* provided on the component 2*b* of the first component so as to connect the spring and the component. The at least one first connecting element comprises at least one elastic connecting arm 10*a* extending in a first direction D1. The first connecting element is intended to receive a force F for driving the first component relative to the second component in the first direction or substantially in the first direction. The first connecting element permits the transmission of the driving force F to the rest of the spring, more particularly to any notching or indexation structures provided on the spring. Advantageously, the at least one elastic connecting arm 10*a* permits the first connecting element to interact with the second connecting element 20*b* provided on the component 2*b* of the first component with reduced play or in the absence of play so as to connect the spring 1 and the component 2*b* with reduced play or in the absence of play.

The spring has an overall annular form in a plane P. In other words, the spring 1 has a geometry in a closed loop in a plane P. More particularly, the overall annular form of the spring may be tangent or substantially tangent to the first direction D1.

Figure 6:
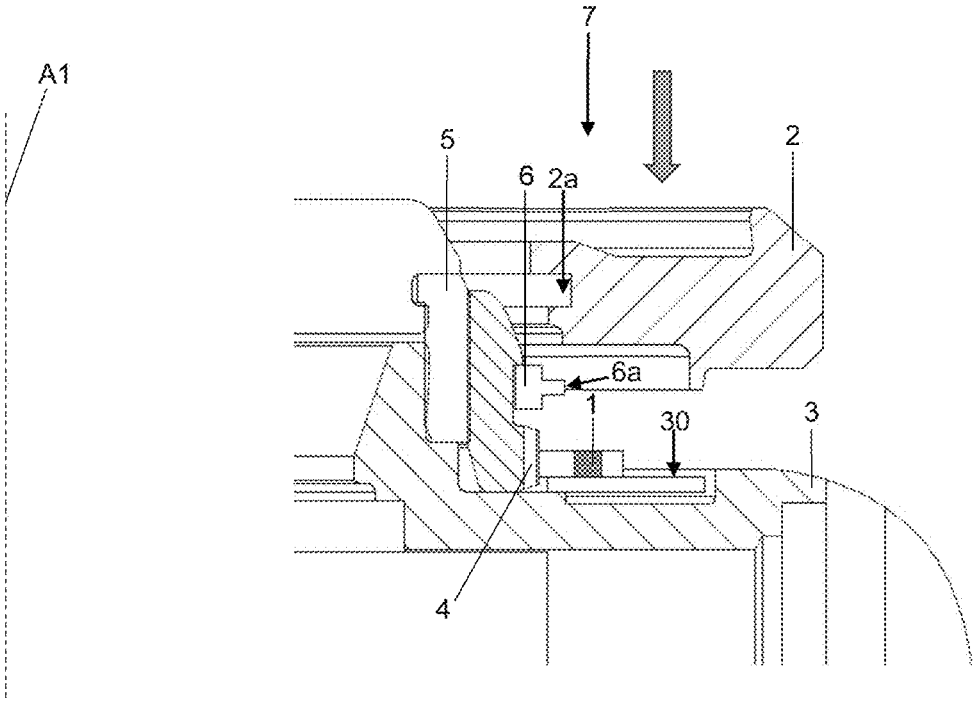
FIGS. 6 to 8 are views illustrating the assembly of a timepiece.
Figure 7:
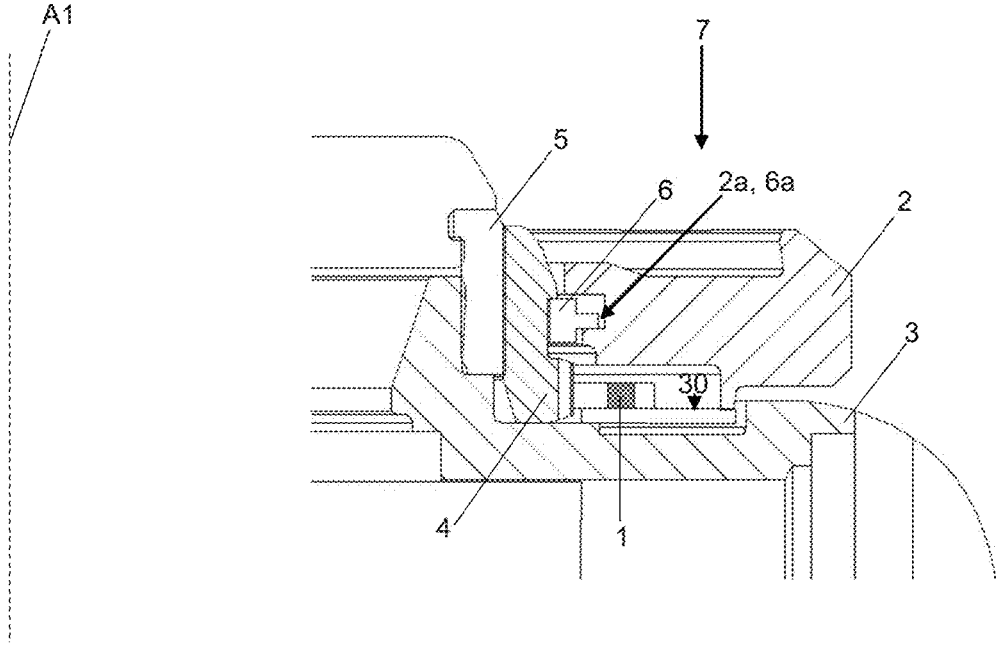

The first direction D1 is preferably orthoradial or substantially orthoradial relative to an axis of rotation A1 of the spring or to an axis A1 passing through the center of gravity G of the spring 1 and perpendicular or substantially perpendicular to the plane P of the spring 1. The axis A1 is preferably also the axis of rotation of the first or the second component as represented in FIGS. 6 and 7.

In the embodiment represented here, the spring 1 comprises three first connecting elements. Preferably, the three first connecting elements are distributed at regular intervals along the circumference of the spring 1.

As an alternative, the spring 1 may comprise a different number of first connecting elements, more particularly two or four or five first connecting elements. More preferably, the different first connecting elements may be distributed at regular intervals along the circumference of the spring 1.

Preferably, the different first connecting elements have identical structures.

Advantageously, the different first connecting elements are disposed at the level of the first indexation or notching structures 21, 31, 41. In other words, the first connecting elements and the first indexation or notching structures may be disposed at the same locations or substantially at the same locations on the spring, said sites being defined angularly about the axis A1.

Advantageously, the first connecting elements and/or the first structures 21, 31, 41 may be distributed at regular intervals on the spring relative to the axis A1.

More generally, the ratio of the number of first connecting elements to the number of first indexation or notching structures may be a whole number or the inverse of a whole number. Preferably, the ratio of the number of first connecting elements to the number of first indexation structures is equal to one.

Each elastic connecting arm comprises a free or distal extremity and an extremity connected to the rest of the spring or a proximal extremity.

Preferably, the one or more free or distal extremities each form a face 101*a* perpendicular or substantially perpendicular to the first direction D1. A suchlike face may or may not be plane.

Advantageously, the one or more free or distal extremities each have a flared form.

Advantageously, each elastic connecting arm has an elongated form. The longitudinal dimension L1 of each elastic connecting arm, measured in the plane P of the spring, may thus be equated substantially to an arc length relative to the axis A1 of the spring. This arc length is proportional to an angle $\alpha l$ represented in FIG. 2. This angle may be expressed in radians. Assuming L2 to be the arc length of each elastic notching arm relative to the axis A1 of the spring, the dimension L1 is preferably between L2/20 and L2/3. The longitudinal dimension L2 of each notching arm measured in the plane P of the spring may also be equated substantially to an arc length relative to the axis A1 of the spring. This arc length is proportional to an angle $\alpha$2 represented in FIG. 2. The dimension $\alpha$1 is preferably between $\alpha$2/20 and $\alpha$2/3.

The longitudinal dimension L2 of an elastic notching arm extends from a characteristic point of a first indexation or notching structure 21, for example an axis of symmetry of the structure, to another characteristic point of another neighboring first indexation or notching structure 41.

Figure 3:
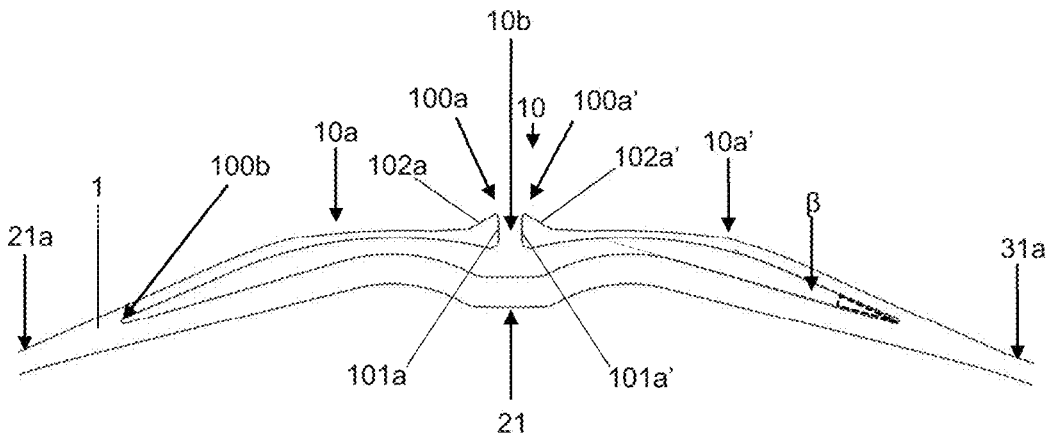
FIG. 3 is a partial view of a notching spring.
Figure 4:
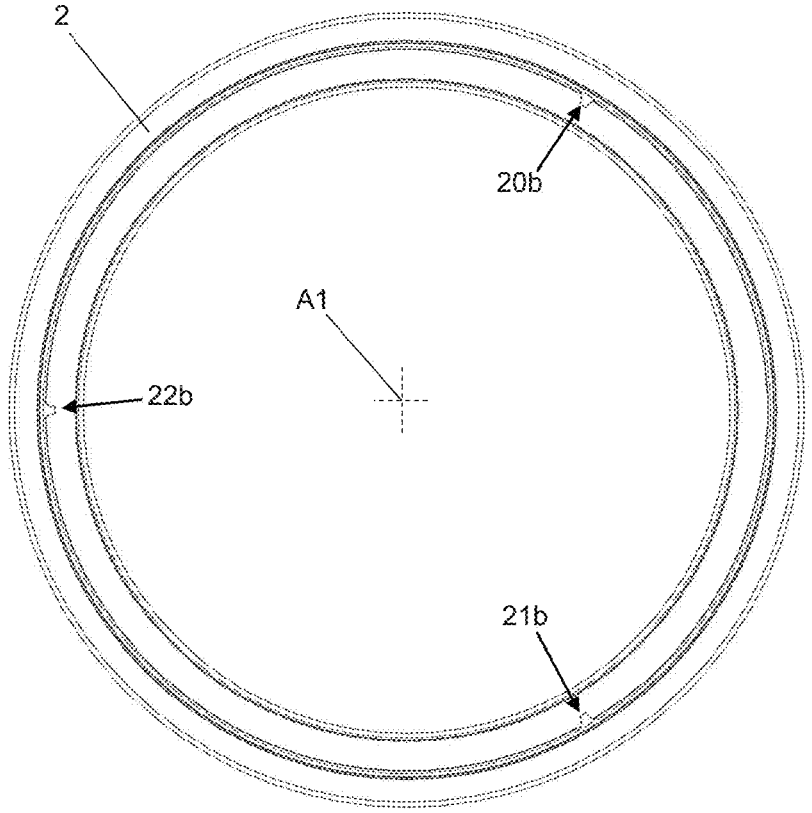
FIG. 4 is a view from above of a bezel, the notching spring not being represented.
Figure 5:
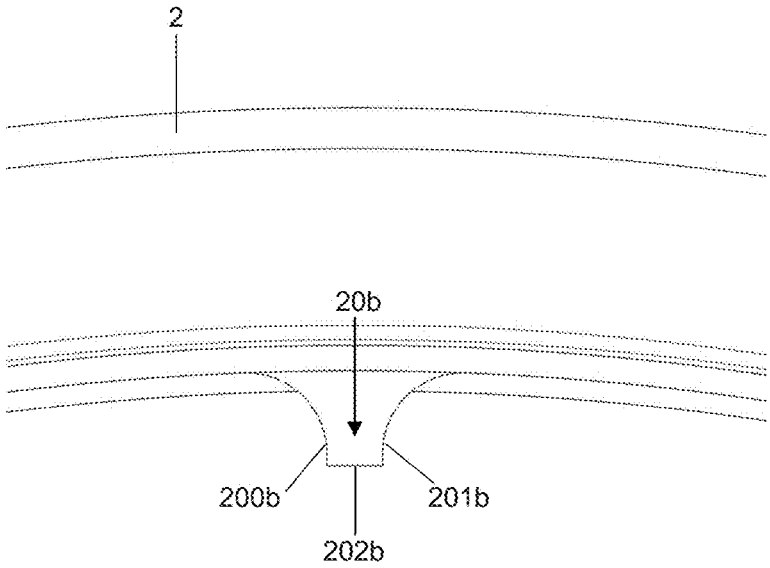
FIG. 5 is a partial view of a bezel, the notching spring not being represented.

The longitudinal dimension L1 of an arm of a first connecting element 12*a* extends from a proximal extremity 100*b* of the arm to a distal extremity 100*a* of the arm. The proximal extremity is defined, for example, as the site of a surface extending radially in the axis A1 or the site where the spring has surfaces of the spring including, in the plane P, tangents forming between them an angle $\beta$ lower than 90°, or lower than 60°, or lower than 30°, as depicted in FIG. 3.

The transverse dimension d1 of each elastic connecting arm is preferably between d2/5 and d2/2,d2 being the transverse dimension of each elastic notching arm. The expression "transverse dimension", is understood to denote the dimension of the section of the spring, measured in the plane P of the spring, in a given radial direction relative to the axis A1 of the spring.

Preferably, the elastic connecting arm has a longitudinal dimension greater than or equal to 15 times, or greater than or equal to 20 times, or greater than or equal to 25 times the transverse dimension d1 of the elastic connecting arm.

Preferably, the thickness e of the spring is constant. More preferably, the ratio d1/e is less than or equal to 1, or less than or equal to 0.5. The expression "thickness" is used here to denote the dimension of the spring in a direction parallel to the axis A1 of the spring.

The one or more elastic connecting arms may have rectangular or substantially rectangular or square or substantially square transverse sections, for example. These sections may be constant or substantially constant along the longitudinal dimension L1 of the elastic connecting arms. As an alternative, the sections may be progressive, that is to say they may vary along the longitudinal dimension L1 of the elastic connecting arms.

The one or more elastic connecting arms 10*a*; 10*a*', 11*a*; 11*a*', 12*a*; 12*a*' are ideally formed in the continuity of elastic notching arms 21*a*, 31*a*, 41*a*, the elastic notching arms being situated to either side of the first indexation or notching structures 21, 31, 41.

The one or more elastic connecting arms may have generally arched or substantially arched forms, for example, with radii of curvature of which the dimension is in the order of magnitude of the radius of the annular form of the spring. For example, the radius of curvature of the elastic connecting arm is between 0.2 times and 1 times the radius of the annular form of the spring. As an alternative, the one or more elastic connecting arms may have generally linear or substantially linear forms.

As seen previously, the at least one first connecting element interacts with the at least one second connecting element in order to connect the spring to the rest of the component, more particularly to the rest of the bezel or to the rest of the case middle or to the rest of the back of the case middle.

The at least one second connecting element comprises at least one protrusion 20*b*, 21*b* and 22*b*, more particularly at least one radial protrusion, for example three radial protrusions. Preferably, the watch assembly comprises the same number of first connecting elements as second connecting elements.

Each protrusion preferably comprises a face 200*b*, 201*b* intended to interact by abutment or by positive engagement with a face 101*a*, 101*a*' of an elastic connecting arm. All or part of the faces 200*b*, 201*b* are themselves preferably also perpendicular to the first direction when they interact with the elastic connecting arms.

Preferably, each first connecting element comprises two elastic connecting arms 10*a*, 10*a*', more particularly two elastic connecting arms of which the free extremities face towards one another, or two arms that are symmetrical relative to a plane P1 comprising the axis of rotation A1 of the spring or the axis A1 passing through the center of gravity G of the spring 1 and orthogonal or substantially orthogonal to the plane P of the spring 1. Thus, each pair of symmetrical arms provides, between the free extremities of the arms, a gap or recess 10*b*, 11*b*, 12*b* in which a second connecting element is intended to be housed.

Each elastic connecting arm may have a retraction ramp 102*a*. As described below, a suchlike retraction ramp permits a second connecting element to deform and retract an elastic connecting arm in the course of a relative displacement of the first and second components during a method of mounting or assembling of the first and second components described below. This deformation and this retraction continue to take place until the one or more second connecting elements fit into the gaps or recesses. In this situation, the one or more deformed elastic connecting arms readopt their form, and the one or more second connecting elements are secured between the elastic connecting arms.

Thus, the spring and the rest of the first component may be connected in two directions of displacement of the first component relative to the second component, that is to say in the two directions defined by the direction D1.

The arrangement and the geometry of the elastic connecting arms 10*a*; 10*a*', 11*a*; 11*a*', 12*a*; 12*a*' are adapted to transmit a higher torque, or a substantially higher torque, than the return torque produced by the elastic notching arms as they return the first and second notching structures one against the other. For this purpose, the at least one first connecting element is arranged so as to transmit a force for driving the first component relative to the second component, of which the intensity may be greater than or equal to 1.5 times, or greater than or equal to 2 times, or greater than or equal to 2.5 times, or greater than or equal to 3 times the intensity of the notching force.

A mode of implementation of a method of mounting or assembling of an aforementioned assembly or of an aforementioned timepiece is described below. The assembly of a rotating bezel on a case middle is described in this mode of implementation.

In a first stage of assembly, the spring 1 is first of all disposed on an annular seat 30 of the case middle 3, and at least one of the structures 21, 31, 41 is disposed in a hollow 40 of the annular cam 4 which is attached to the case middle 3. The spring 1 is thus maintained in an angular and axial position, pending a second stage of assembly, by the pretensioning of the elastic arms 21*a*, 31*a*, 41*a*.

Advantageously, the cam 4 encloses a seal 5 of the case 7. More advantageously, the cam 4 carries an annular element 6 for the retention of the bezel 2, such as that which is the object of patent application EP1416341A1. This element 6 has an annular portion 6*a* intended for insertion into an annular groove 2*a* of the bezel 2 in the course of the assembly of the bezel 2 on the case middle 3.

In other words, in the first stage, the first component 2 is installed or positioned on the second component 3.

In a second stage of assembly, the bezel 2 is connected axially to the case middle 3 by means of the annular element 6. FIG. 6 depicts a sectional view of the notching device during stage 2. The bezel 2 is brought axially closer to the annular seat 30 of the case middle 3 and has a structure that is defined so as to permit an elastic deformation of the portion 6*a* of the element 6 and, in so doing, to permit its insertion into the groove 2*a* of the bezel 2, as represented in the sectional view in FIG. 7.

The assembly of the bezel 2 on the case middle 3 may be performed in this case irrespective of the angular position of the bezel 2 relative to the case middle 3, and differs in this respect from the assembly of a notching device such as that described in application EP1431845.

Figure 8:
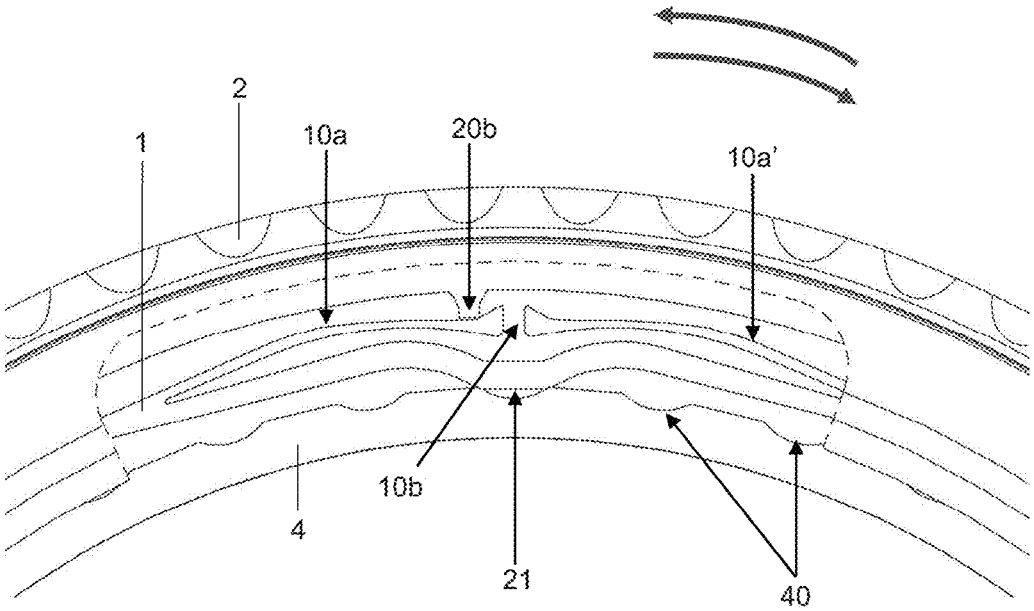

In a third stage of assembly depicted in FIG. 8, the bezel is subsequently rotated through an indefinite angle so as to permit the insertion of the second connecting elements 20*b*, 21*b*, 22*b* of the bezel 2 into the gaps 10*b*, 11*b*, 12*b* of the spring 1. For this purpose, the elastic connecting arms 10*a*; 10*a*', 11*a*; 11*a*', 12*a*; 12*a*' of the spring 1 are configured to be deformed elastically under the effect of the second connecting elements 20*b*, 21*b*, 22*b* during rotation of the bezel 2, and more particularly under the effect of the radial force caused by the respective extremities 202*b*, 212*b*, 222*b* of the second connecting elements of the bezel 2, until the insertion of the second connecting elements in the gaps 10*b*, 11*b*, 12*b*. Advantageously, the distal extremities 100*a*; 100*a*', 110*a*; 110*a*', 120*a*; 120*a*' of the elastic connecting arms may be equipped with inclined surfaces or ramps 102*a*; 102*a*', 112*a*; 112*a*', 122*a*; 122*a*' defined specifically to permit the optimized retraction of the elastic connecting arms as represented in FIG. 3.

This third stage of assembly thus corresponds to a stage of assembly of the bayonet type. Once the first connecting elements 20*b*, 21*b*, 22*b* of the bezel 2 are accommodated in the gaps provided on the spring 1, as a consequence of the rotation of the bezel with respect to the spring 1 which is predisposed on the case middle 3, the spring 1 is constrained to rotate with the bezel 2 in two directions of rotation about the axis A1.

In other words, this third stage comprises:

- a displacement, more particularly a rotation, of the first component relative to the second component and deformation, more particularly bending deformation, of the one or more elastic connecting arms of the spring by the action of the one or more second connecting elements on the one or more elastic connecting arms of the spring, and
- a return of the one or more elastic connecting arms of the spring so as to position the extremity of the one or more arms of the spring at the level of the one or more second connecting elements.

Advantageously, the one or more elastic connecting arms of the spring are deformed in bending in the plane P of the spring in the course of the retraction of the one or more elastic connecting arms. As an alternative or in addition, the one or more elastic connecting arms may be caused to deform in bending perpendicularly to the plane P of the spring.

In the preceding description, the elastic connecting arms for the connection of the spring to the rest of the first component, more particularly to the rest of the bezel, are provided on the spring. As an alternative or in addition, elastic connecting arms for the connection of the spring to the rest of the first component, more particularly to the rest of the bezel, may be provided on the rest of the first component. In this case, the spring may be provided by at least one protrusion intended to interact with the elastic connecting arms provided on the rest of the first component, more particularly on the rest of the bezel. The one or more elastic arms may be realized on a principal body of the first component, more particularly of the bezel, or may be realized on a ring attached to the principal body of the first component, more particularly of the bezel.

In the preceding description, the notching spring is intended to be connected to the bezel. Nevertheless, it is, of course, possible to connect the notching spring to a back of a case middle according to the same principle. The spring configured in this way may thus be intended to receive a force F for driving a bezel or a back of a case middle relative to a case middle. It is similarly possible to connect the notching spring to a case middle according to the same principle. In the latter case, the spring may likewise be intended to receive a force F for driving a bezel or a back of a case middle relative to said case middle.

In the preceding description, the elastic connecting arms are organized in pairs so as to form a gap between the free extremities of the arms of a pair. One of the arms of the pair could be replaced by a rigid abutment, however. In this case, a gap for accommodating a second connecting element is realized between the rigid abutment and the extremity of an arm. The first connecting elements are then no longer symmetrical, and the connection may be performed only by displacement of the component of the first component in a single direction relative to the spring.

In this whole document, the term "to connect" has preferably a meaning such that a first element connected to a second element has no ability to move regarding to the second element. In particular, the rotation of the first element around the axis A1 causes the rotation of the second element.

However, in this whole document, the terms "to index" and "to notch" have preferably a meaning such that a first element indexed regarding to a second element has at least some ability to move regarding to the second element. In particular, the rotation of the first element around the axis A1 regarding to the second element is allowed. The movement of the first element regarding to the second element is preferably allowed from one predetermined (indexed) position to another predetermined (indexed) position. The predetermined positions are defined by indexation means.

The invention claimed is:

1. A watch spring for a first component, intended for the notching of the first component relative to a second component, the spring comprising:

at least one first connecting element intended to interact with at least one second connecting element provided on a member of the first component so as to connect the spring and the first component, wherein the at least one first connecting element comprises at least one elastic connecting arm extending in a first direction intended to interact with the at least one second connecting element, the at least one first connecting element being intended to receive a force for driving the first component relative to the second component in the first direction or substantially in the first direction, wherein the first direction is orthoradial relative to an axis of rotation of the spring or the first direction is orthoradial relative to an axis passing through the center of gravity of the spring and the axis passing through the center of gravity of the spring being perpendicular or substantially perpendicular to the spring or to a plane in which the spring extends.

2. The watch spring as claimed in claim 1, wherein the elastic connecting arm has a free extremity forming a face perpendicular or substantially perpendicular to the first direction.

3. The watch spring as claimed in claim 1, wherein the spring has an overall annular form.

4. The watch spring as claimed in claim 3, wherein the form of the spring is tangent or substantially tangent to the first direction.

5. The watch spring as claimed in claim 1, wherein the first connecting element comprises two elastic connecting arms.

6. The watch spring as claimed in claim 5, wherein the spring comprises at least one selected from the group consisting of:

free extremities of the two elastic connecting arms face towards one another, and free extremities of the two elastic connecting arms are symmetrical relative to a plane comprising an axis passing through the center of gravity of the spring and orthogonal or substantially orthogonal to the spring or to a plane in which the spring extends.

7. The watch spring as claimed in claim 1, wherein the spring comprises several first connecting elements.

8. The watch spring as claimed in claim 7, wherein the several first connecting elements are distributed at regular intervals along the circumference of the spring.

9. The watch spring as claimed in claim 1, wherein the spring comprises at least one first indexation or notching structure intended to interact with at least one second indexation or notching structure provided on a second component.

10. The watch spring as claimed in claim 1, wherein the first connecting element is disposed at the level of one of the at least one first structure.

11. A watch component comprising the watch spring as claimed in claim 1.

12. A watch assembly comprising a first watch component which is the watch component as claimed in claim 11, and a second watch component, the second watch component comprising a second indexation or notching structure adapted to interact with at least one first indexation or notching structure provided on the first component.

13. The watch assembly as claimed in claim 12, wherein the at least one first connecting element is arranged so as to transmit a force for driving the first component relative to the second component, wherein an intensity of the force is greater than or equal to 1.5 times an intensity of a notching force.

14. A timepiece comprising the assembly as claimed in claim 12.

15. A method for mounting or assembling the assembly as claimed in claim 12, the method comprising:

installing the first component on the second component, displacing the first component relative to the second component and deforming the elastic connecting arm of the spring by the second connecting element acting on the elastic connecting arm, and returning the elastic connecting arm of the spring so as to position an extremity of the elastic connecting arm at a level of the second connecting element.

16. The method of mounting or assembling as claimed in claim 15, wherein the elastic connecting arm is deformed in bending in at least one selected from the group consisting of (i) a plane of the spring and a direction perpendicular to the plane of the spring.

17. The watch component as claimed in claim 11, which is a bezel or a case middle or a case back.

18. The watch spring as claimed in claim 1, wherein the elastic connecting arm has a longitudinal dimension greater than or equal to 15 times a transverse dimension of the elastic connecting arm.

19. The watch spring as claimed in claim 1, wherein the elastic connecting arm has a retraction ramp.

* * * * *